United States Patent [19]

Nicholls

[11] 4,136,481

[45] Jan. 30, 1979

[54] TOY FIGURES

[75] Inventor: Bryan F. Nicholls, Northampton, England

[73] Assignee: The Mettoy Company Limited, Northampton, England

[21] Appl. No.: 763,232

[22] Filed: Jan. 27, 1977

[30] Foreign Application Priority Data

Sep. 11, 1976 [GB] United Kingdom ..... 37730/76
Oct. 28, 1976 [GB] United Kingdom ..... 44927/76

[51] Int. Cl.[2] ..... A63H 33/00
[52] U.S. Cl. ..... 46/22; 46/161
[58] Field of Search ..... 46/161, 162, 163, 173, 46/119, 22

[56] References Cited

U.S. PATENT DOCUMENTS

| | | | |
|---|---|---|---|
| 1,683,561 | 9/1928 | Letson | 46/119 |
| 2,767,516 | 10/1956 | Del Mas | 46/161 |
| 3,032,921 | 5/1962 | Greene | 46/118 |
| 3,699,713 | 10/1972 | Sapkus et al. | 46/119 |
| 3,740,894 | 6/1973 | Howland et al. | 46/161 |
| 3,874,113 | 4/1975 | Beck | 46/161 |
| 3,900,992 | 8/1975 | Klamer | 46/161 |
| 3,946,517 | 3/1976 | Goldfarb et al. | 46/22 |
| 3,995,395 | 12/1976 | Rahmstorf | 46/22 X |

FOREIGN PATENT DOCUMENTS

| | | | |
|---|---|---|---|
| 1275858 | 5/1972 | United Kingdom | 46/161 |
| 1286729 | 8/1972 | United Kingdom | 46/161 |

*Primary Examiner*—Russell R. Kinsey
*Assistant Examiner*—Mickey Yu
*Attorney, Agent, or Firm*—Brisebois & Kruger

[57] ABSTRACT

A poseable figure simulating a human-being comprises a body whose lower end is open to receive a leg assembly articulated for movement relative to the body fore and aft, side-to-side and also about the axis of a longitudinal stem which carries the head and makes snap fitting engagement with the leg assembly. A resilient bias acts between the body and leg assembly both to take up clearances and to provide a degree of frictional restraint to hold the parts in desired relative positions.

7 Claims, 5 Drawing Figures

TOY FIGURES

This invention relates to toy figures.

Previously proposed toy figures comprise a body, and legs which are mounted in the body, or in a support element contained within the body, for pivotal movement about a transverse axis between an upright standing position and a sitting position in which the legs are generally perpendicular to the body. The legs may be formed as a unitary structure to move in unison or they may be formed separately and move independently of each other.

In the prior toy figures of this general form of which we are currently aware, the legs are journalled for pivotal movement about a transverse axis which is fixed relative to the body.

The present invention aims at the provision of a toy figure of this general character, in which the legs are capable of an extra degree of movement, without unduly complicating the design and manufacturing procedures involved.

The present invention provides a toy figure comprising a hollow body having an opening at its lower end, and a leg assembly comprising a pair of legs and having an upper end portion received in the lower body cavity, the leg assembly having journal means permitting pivoting movement of the legs relative to the body between a standing position in which they extend downwardly from the body and a sitting position in which they extend forwardly of the body, and the upper end portion of the leg assembly being journalled for rotation of the leg assembly relative to the body about an axis extending longitudinally of the body.

By making the legs part of an articulated assembly wide scope is given for the manner in which the legs are journalled for rotation about the longitudinal axis of the body and for retaining the leg assembly against inadvertent removal, without marring the external appearance of the completed figure.

In a particularly economic and advantageous design, the figure comprises a stem which extends downwardly through the body, and carries a head at its upper end, the lower end of the stem co-operating with the leg assembly to inhibit its removal.

The stem can also serve to lock in place a removable body section simulating the chest of a human being.

The lower end of the stem may have at its lower end an enlargement to make snap-fitting interengagement with the leg assembly, so that insertion of the stem serves to position the head on the body and to secure the leg assembly as one simple assembly step.

A very satisfactory journalling of the leg assembly can be achieved by giving the upper end of the leg assembly a part-spherical shape which co-operates with a cylindrical lower wall portion of the body. The wall portion is preferably of integral continuous form, in order to provide a secure seating for the leg assembly.

The leg assembly preferably comprises a pair of separate leg members and a centre fitting to which the legs are journalled for independent movement. It is then a simple matter to arrange for the leg assembly to be retained to the body, in a manner permitting of its rotation about a longitudinal body axis.

Preferably, the body includes a resilient diaphragm or equivalent means to apply a spring bias to the leg assembly, thereby taking up clearance between the leg assembly and the body, as well as assisting in providing frictional restraint which helps to maintain the leg assembly in any desired position of adjustment relative to the body.

In the presently preferred forms of the invention described below, the leg assembly is additionally pivotable, relative to the body, about a third axis, extending fore-and-aft of the body, to allow the body to rock from side-to-side.

A presently preferred form of figure in accordance with the invention will now be described in detail, by way of example, with reference to the accompanying drawings, in which.

Figure 1:
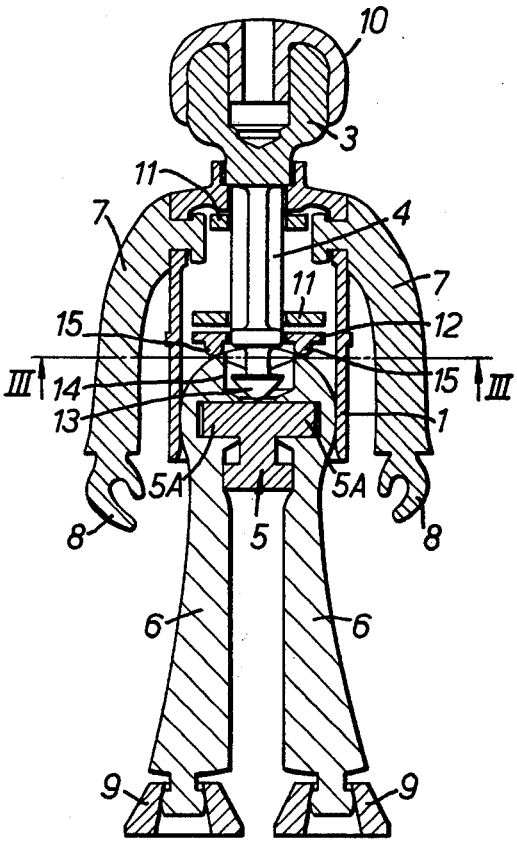
FIGS. 1 and 2 are front and side sectional elevations.
Figure 2:
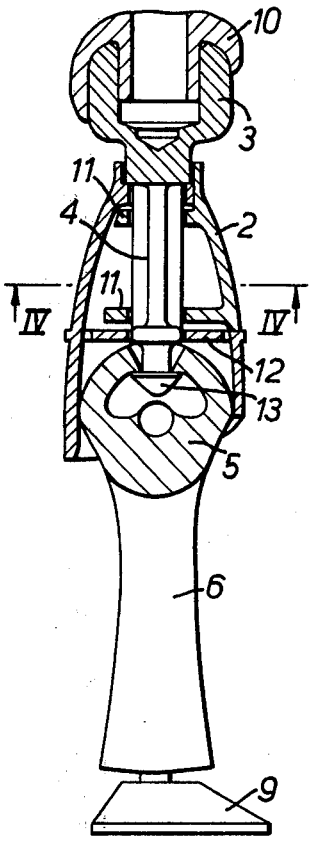
Figure 3:
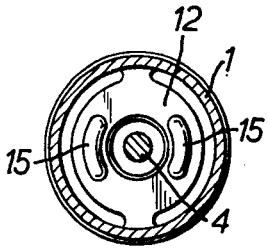
FIG. 3 is a section on the line III—III of FIG. 1.
Figure 4:
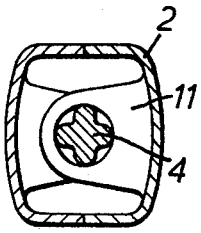
FIG. 4 is a section on the line IV—IV of FIG. 2.

The toy figure which is conveniently composed of synthetic resin injection mouldings, comprises a hollow body formed by a main section 1 and a front quarter section 2, a head 3 formed integrally with a stem 4, a leg assembly comprising a centre fitting 5 and separate legs 6 and a pair of arms 7 rotatably mounted in the main body section 1. The arms terminate in claw-like hands 8 and the legs in articulated feet 9. The head 3 has a scalp-like hood 10 on which accessories such as hats or head-dresses can be mounted.

The stem 4, over most of its length, is of cruciform section (to facilitate moulding) and passes through a pair of lugs 11 integral with the quarter section 2 to hold the latter in place, through a web 12 in the section 1, and terminates in a mushroom head enlargement 13 which makes snap fitting interengagement with the centre fitting 5 of the leg assembly. This fitting has a re-entrant transverse slot 14 and two laterally extending aligned trunnions 5A into which the legs 6 are journalled.

The upper portion of the leg assembly is part-spherical and is journalled in a cylindrical wall portion of the lower body and also bears upwardly against a pair of pips 15 or other bearing surfaces provided on the underside of the web 12, which is resilient.

In assembly of the toy figure, the stem is passed downwardly through the body, and the leg assembly upwardly into the lower body portion, so that the enlargement 13 snaps into the slot 14 of the centre fitting 5. In this operation, the web 12 is strained upwardly and its resilience takes up slack in the assembly and provides a degree of frictional restraint between the leg assembly and the body, and also between the head and the body, both the head and the leg assembly, however, being rotatable about the axis of the stem.

Additionally, the body can tilt from side-to-side to a limited degree, about a fore-and-aft axis, and the legs can pivot fore-and-aft, independently of each other, on the trunnions 5A.

Figure 5:
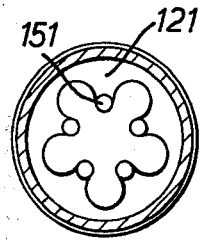

In a modified version, shown in FIG. 5, the web 121 is formed with a central lobed aperture so as to define a number of springy, inwardly directed radial fingers carrying pips 151 bearing against the leg assembly.

Forming the body with a separate front quarter section 2 permits interchange of alternative sections 2 on assembly, for example to provide a choice as between male and female forms. It also allows the lower cylindrical wall section of the body to be of continuous, integral form.

The figure has a wide range of possible postures to enhance its play value, but comprises a relatively small number of components, which is obviously advantageous for production and assembly.

I claim:

1. A toy figure comprising an elongate hollow body having an opening at its lower end, a leg assembly including a pair of legs and having an upper end portion extending into and within said opening, said leg assembly also including journal means permitting pivotal movement of said legs relative to said body between a standing position and a sitting position, means journalling said upper end portion in said opening for rotation of said legs relative to said body about an axis extending generally longitudinally of said body and an elongate stem extending downwardly into said body through an upper body opening and carrying a head at its upper end, said stem having an enlargement at its lower end having snap fitting engagement in an aperture provided in said leg assembly to hinder removal of said assembly from said body.

2. A toy figure according to claim 1, wherein said upper portion of said leg assembly is of part-spherical shape and is journalled in a generally cylindrical wall portion of said body.

3. A toy figure according to claim 2, wherein said body has a generally cylindrical lower wall portion of continuous integral form for reception and journalling of said leg assembly.

4. A toy figure according to claim 1, wherein said leg assembly comprises two separate legs and a centre fitting to which said legs are separately journalled to permit the said pivoting movement thereof.

5. A toy figure as claimed in claim 4, wherein said resilient means comprises a diaphragm of resilient material extending transversely of said body in bearing engagement with said leg assembly.

6. A toy figure as claimed in claim 1, further comprising resilient means on said body bearing downwardly against said leg assembly, thereby to take up clearance between said body and said leg assembly.

7. A toy figure comprising an elongate body having a neck opening at its upper end, a transverse resilient diaphragm intermediate its upper and lower ends, and a tubular portion beneath the diaphragm open from below, a leg assembly comprising a centre fitting and two legs pivotally mounted on said centre fitting, said leg assembly presenting a bulbous, generally hemispherical upper end portion received in said tubular portion of said body, an elongate stem extending rotatably through said neck opening and through an opening in said diaphragm, said stem having an upper end carrying a head and having a lower end disposed adjacent said centre fitting and cooperating therewith to hinder removal of said leg assembly from said body and journal means operative between said leg assembly and said body to permit rotation of said leg assembly relative to said body about a longitudinal axis of said stem, said diaphragm bearing downwardly on said leg assembly, whereby to take up play between said body, head and leg assembly in a direction longitudinally of said stem.

* * * * *